US010453469B2

(12) United States Patent
Madhu et al.

(10) Patent No.: US 10,453,469 B2
(45) Date of Patent: Oct. 22, 2019

(54) SIGNAL PROCESSOR

(71) Applicant: NXP B.V., Eindhoven (NL)

(72) Inventors: Nilesh Madhu, Kessel-Lo (BE); Wouter Joos Tirry, Wijgmaal (BE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/935,243

(22) Filed: Mar. 26, 2018

(65) Prior Publication Data

US 2018/0315439 A1 Nov. 1, 2018

(30) Foreign Application Priority Data

Apr. 28, 2017 (EP) ..... 17168797

(51) Int. Cl.

| | |
|---|---|
| ***G10L 21/02*** | (2013.01) |
| ***G10L 21/0232*** | (2013.01) |
| ***G10L 25/21*** | (2013.01) |
| ***G10L 25/18*** | (2013.01) |
| ***G10L 21/0216*** | (2013.01) |
| ***G10L 19/093*** | (2013.01) |

(Continued)

(52) U.S. Cl.

CPC ..... *G10L 21/0205* (2013.01); *G10L 21/0232* (2013.01); *G10L 25/18* (2013.01); *G10L 25/21* (2013.01); *G10L 19/093* (2013.01); *G10L 21/0216* (2013.01); *G10L 21/038* (2013.01); *G10L 25/90* (2013.01)

(58) Field of Classification Search

CPC . G10L 25/24; G10L 21/0205; G10L 21/0232; G10L 25/18; G10L 25/21

See application file for complete search history.

(56) References Cited

U.S. PATENT DOCUMENTS 6,233,550 B1 * 5/2001 Gersho ..... G10L 19/10 704/208
8,219,390 B1 * 7/2012 Laroche ..... G10L 21/0272 704/207

(Continued)

OTHER PUBLICATIONS

Speech Enhancement Using Harmonics Regeneration Based on Multiband Excitation1 Zhang Yanfang Tang Kun Cui Huijuan (National Laboratory for Information Science and Technology, Tsinghua University, (Year: 2011).*

Plapous, Cyril et al; "Improved Signal-to-Noixe Ratio Estimation for Speech Enhancement"; IEEE Transactions on Audio Speech and Language Processing, vol. 14, No. 6; pp. 2098-2018 (Nov. 2006).

Ephraim, Yariv et al; "Speech Enhancement Using a Minimum Mean-Square Error Short-Time Spectral Amplitude Estimator"; IEEE Transactions on Acoustics Speech and Signal Processing, vol. ASSP-32, No. 6; pp. 1109-1121 (Dec. 1984).

(Continued)

*Primary Examiner* — Mohammad K Islam

(57) ABSTRACT

A signal processor comprising: a modelling block, configured to receive a frequency-domain-input-signal, a fundamental-frequency-signal representative of a fundamental frequency of the frequency-domain-input-signal; and configured to provide a pitch-model-signal based on a periodic function, the pitch-model-signal spanning a plurality of discrete frequency bins, each discrete frequency bin having a respective discrete frequency bin index, wherein within each discrete frequency bin the pitch-model-signal is defined by: the periodic function; the fundamental frequency; the frequency-domain-input-signal; and the respective discrete frequency bin index. The signal processor further comprises a manipulation block, configured to provide an output-signal based on the frequency-domain-input-signal and the pitch-model-signal.

15 Claims, 3 Drawing Sheets

(51) Int. Cl.
*G10L 25/90* (2013.01)
*G10L 21/038* (2013.01)

(56) References Cited

U.S. PATENT DOCUMENTS

| | | | | |
|---|---|---|---|---|
| 9,043,203 | B2 * | 5/2015 | Rettelbach | G10L 19/02 704/226 |
| 9,489,959 | B2 * | 11/2016 | Nagisetty | G10L 19/24 |
| 9,570,057 | B2 * | 2/2017 | Brown | G10H 1/125 |
| 9,947,341 | B1 * | 4/2018 | Marsh | G10L 25/24 |
| 10,014,005 | B2 * | 7/2018 | Sun | G10L 25/78 |
| 2008/0019538 | A1 * | 1/2008 | Kushner | A62B 18/08 381/94.1 |
| 2009/0210224 | A1 * | 8/2009 | Fukuda | G10L 15/02 704/233 |
| 2013/0339010 | A1 * | 12/2013 | Kikuiri | G10L 21/0388 704/203 |
| 2017/0133029 | A1 * | 5/2017 | Markovic | G10L 19/26 |
| 2017/0287510 | A1 * | 10/2017 | Khanagha | G10L 25/06 |
| 2017/0323656 | A1 | 11/2017 | Elshamy et al. | |
| 2018/0174571 | A1 * | 6/2018 | Tamura | G10L 13/06 |
| 2018/0233154 | A1 * | 8/2018 | Vaillancourt | G10L 25/21 |
| 2018/0357995 | A1 * | 12/2018 | Lee | G10K 11/175 |

OTHER PUBLICATIONS

Zavarehei, Esfandiar et al; "Noisy Speech Enhancement Using Harmonic-Noise Model and Codebook-Based Post-Processing"; IEEE Transactions on Audio, Speech and Language Processing, vol. 15, No. 4; pp. 1194-1203 (May 1, 2007).

Tilp, Jan; "Single-channel noise reduction with pitch-adaptive post-filtering"; Proc. 10th European Signal Processing Conference; 4 pages (2000).

Krini, Mohamed et al; "Model-Based Speech Enhancement"; Speech and Audio Processing in Adverse Environments; Springer Berlin Heidelberg; pp. 89-134 (2008).

Chen, Ruofei et al; "Model-Based Speech Enhancement with Improved Spectral Envelope Estimation via Dynamics Tracking"; IEEE Transactions on Audio, Speech and Language Processing, vol. 20, No. 4; pp. 1324-1336 (May 2012).

Charoenruengkit, Werayuth et al; "Multiband Excitation for Speech Enhancement"; Digital Signal Processing and 5th IEEE Signal Processing Workshop 2009; IEEE, Piscataway, NJ, USA; pp. 10-15 (Jan. 4, 2009).

Yanfang, Zhang et al; "Speech enhancement using harmonics regeneration based on multiband excitation"; Journal of Electronics (China); SP Science Press, Heidelberg vol. 28, No. 4-6; pp. 565-670 (Nov. 2011).

* cited by examiner

SIGNAL PROCESSOR

CROSS-REFERENCE TO RELATED APPLICATIONS

This application claims the priority under 35 U.S.C. § 119 of European patent application no. 17168797.3, filed Apr. 28, 2017 the contents of which are incorporated by reference herein.

The present disclosure relates to signal processors and methods for signal processing.

According to a first aspect of the present disclosure there is provided a signal processor comprising:

a modelling block, comprising a modelling-block-input-signal-terminal configured to receive a frequency-domain-input-signal;

a fundamental-frequency-input-terminal configured to receive a fundamental-frequency-signal representative of a fundamental frequency of the frequency-domain-input-signal; and a modelling-output-terminal, configured to provide a pitch-model-signal based on a periodic function, the pitch-model-signal spanning a plurality of discrete frequency bins, each discrete frequency bin having a respective discrete frequency bin index, wherein within each discrete frequency bin the pitch-model-signal is defined by:

the periodic function;

the fundamental frequency;

the frequency-domain-input-signal; and the respective discrete frequency bin index, a manipulation block, comprising:

a manipulation-block-input-signal-terminal configured to receive a representation of the frequency-domain-input-signal;

a model-input-terminal configured to receive a representation of the pitch-model-signal from the modelling block; and an output-terminal, wherein the manipulation block is configured to provide an output-signal, to the output-terminal, based on the frequency-domain-input-signal and the pitch-model-signal.

In one or more embodiments, the pitch-model-signal may comprise an amplitude for each discrete frequency bin, each respective amplitude may be determined in accordance with the frequency-domain-input-signal.

In one or more embodiments, the pitch-model-signal may comprise an offset, added to the periodic function, for each discrete frequency bin, each respective offset may be determined in accordance with the frequency-domain-input-signal.

In one or more embodiments, the pitch-model-signal may be limited to an upper maximum value for each discrete frequency bin, each respective upper maximum value may be determined in accordance with the frequency-domain-input-signal.

In one or more embodiments, the pitch-model-signal may be limited to a lower minimum value for each discrete frequency bin, each respective lower minimum value may be determined in accordance with the frequency-domain-input-signal.

In one or more embodiments, the pitch-model-signal may be based on the modulus of the periodic function exponentiated to a power for each discrete frequency bin, each respective power may be determined in accordance with the frequency-domain-input-signal.

In one or more embodiments, the pitch-model-signal may comprise a frequency-offset determined in accordance with the frequency-domain-input-signal.

In one or more embodiments, the pitch-model-signal may comprise a frequency-offset for each discrete frequency bin, each respective frequency-offset may be determined in accordance with the frequency-domain-input-signal.

In one or more embodiments, the periodic function may be a cosine function.

In one or more embodiments, the signal processor may further comprise an a-priori-signal-to-noise-ratio-estimation block, comprising:

a noise-power-estimate-terminal, configured to receive a noise-power-estimate-signal based on the frequency-domain-input-signal;

a manipulation-input-terminal coupled to the output-terminal of the manipulation block and configured to receive the output-signal; and an a-priori-signal-to-noise-ratio-estimation-output terminal, configured to provide an a-priori-signal-to-noise-ratio-estimation-signal based on the noise-power-estimate-signal and the output-signal.

In one or more embodiments, the manipulation block may further comprise an envelope-estimation-block configured to receive the frequency-domain-input-signal and determine an envelope-signal based on the frequency-domain-input-signal and predetermined-envelope-data, and wherein the manipulation block may be configured to provide the output-signal based on a combination of the pitch-model-signal and the envelope-signal.

In one or more embodiments, the manipulation block may be configured to provide the output-signal based on a product of the envelope-signal with the pitch-model-signal for a selected subset of the plurality of discrete frequency bins.

In one or more embodiments, the selected subset of the plurality of discrete frequency bins may relate to frequencies that exceed a bandwidth of the frequency-domain-input-signal.

In one or more embodiments, the manipulation block may further comprise a further-enhancement-block configured to receive the output-signal and the frequency-domain-input-signal and to provide a further-enhancement-signal based on a weighted combination of the output-signal and the frequency-domain-input-signal.

In one or more embodiments, there may be provided an integrated circuit or an electronic device comprising any signal processor of the present disclosure.

According to a further aspect of the present disclosure there is provided a computer program, which when run on a computer, causes the computer to configure any signal processor, system or device disclosed herein, or perform any method disclosed herein.

According to a further aspect of the present disclosure there is provided a method of signal processing comprising:

receiving a frequency-domain-input-signal;

receiving a fundamental-frequency-signal representative of a fundamental frequency of the frequency-domain-input-signal; and providing a pitch-model-signal based on a periodic function, the pitch-model-signal spanning a plurality of discrete frequency bins, each discrete frequency bin having a respective discrete frequency bin index, wherein within each discrete frequency bin the pitch-model-signal is defined by:

the periodic function;

the fundamental frequency;

the frequency-domain-input-signal; and the respective discrete frequency bin index, receiving a representation of the frequency-domain-input-signal;

receiving a representation of the pitch-model-signal; and providing an output-signal based on the frequency-domain-input-signal and the pitch-model-signal.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

The above discussion is not intended to represent every example embodiment or every implementation within the scope of the current or future Claim sets. The figures and Detailed Description that follow also exemplify various example embodiments. Various example embodiments may be more completely understood in consideration of the following Detailed Description in connection with the accompanying Drawings.

BRIEF DESCRIPTION OF DRAWINGS

One or more embodiments will now be described by way of example only with reference to the accompanying drawings in which.

Figure 1:
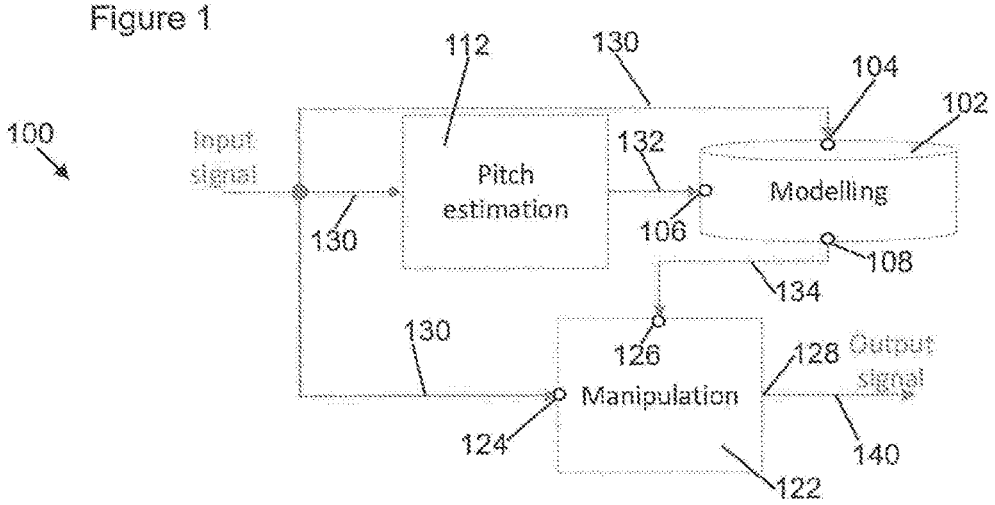
FIG. 1 shows an example embodiment of a signal processor.

Telecommunication systems are one of the most important ways for humans to communicate and interact with each other. Whenever speech is transmitted over a channel, channel limitations or adverse acoustic environments at the near-end can harm comprehension at the far-end (and vice versa) due to, e.g., interference captured by a microphone. Therefore, speech enhancement algorithms have been developed for the downlink and the uplink.

Speech enhancement schemes may compute a gain function generally parameterized by an estimate of the background noise power and an estimate of the so-called a priori Signal-to-Noise-Ratio (SNR). The a priori SNR has a significant impact on the quality of the enhanced signal as it directly affects the suppression gains and is also responsible for the responsiveness of the system in highly dynamic noise environments. Especially in situations with poor SNR, some approaches are unable to accurately estimate the a priori SNR and this leads to destroying the harmonic structure of the speech, reverberation effects and other unwanted audible artefacts such as, for example, musical tones. All of these impair the quality and intelligibility of the processed signal.

To allow for a better estimate of the a priori SNR and to target an improved preservation of harmonics whilst reducing audible artefacts and reverberation, a method based on manipulation of the cepstrum of the excitation signal may be used. However, this cepstrum approach, while improving upon some other approaches can have several drawbacks in some applications. For example:

it can be restricted to operations in the cepstral domain, it can generate an improved excitation signal only for the signal bandwidth taken into the cepstrum calculation. That is, if the cepstrum is computed on a signal at sampling frequency $f_s$, it may not be possible to extend the improved excitation signal to a bandwidth beyond $f_s/2$. This can restrict this method's applicability to other signal enhancement applications, such as artificial bandwidth extension, for example.

the approach may not be able to model pitch harmonic jitter. Pitch harmonic jitter occurs when the pitch harmonics are not exact integer multiples of the fundamental frequency, but deviate slightly from it. This is most visible in rising or falling vowel sounds. The cepstrum approach would, in this case, attenuate true harmonics.

the cepstrum approach may be restricted to pitch frequencies corresponding to integer cepstral bin values. Intermediate frequencies cannot be well modelled by this approach and, indeed, the excitation spectrum generated in such cases can deviate from the underlying signal spectrum for higher frequencies. This can also lead to signal attenuation at these frequencies.

One or more examples disclosed herein can address one or more of the above limitations by introducing a better (more flexible) model for the spectrum of the pitch harmonics.

Speech can be broadly distinguished into two classes: voiced and unvoiced. In voiced speech, the signal spectrum shows a strongly harmonic structure, with peaks in the spectrum at multiples of the so-called fundamental frequency (denoted further in the text as $f_0$). This combination of the spectral peaks at multiples of the fundamental frequency shall, in the following, be termed pitch frequencies or pitch harmonics. The present disclosure provides a method to model the structure of the signal spectrum during such voiced segments, in particular, the pitch frequencies.

FIG. 1 shows a schematic diagram of a signal processor 100. The signal processor 100 has a modelling block 102, a manipulation block 122 and an optional pitch estimation block 112.

The modelling block 102 has a modelling-block-input-signal-terminal 104 configured to receive a frequency-domain-input-signal 130. The modelling block 102 also has a fundamental-frequency-input-terminal 106 configured to receive a fundamental-frequency-signal 132 representative of a fundamental frequency of the frequency-domain-input-signal 130. In this example, the fundamental-frequency-signal 132 is provided by the pitch estimation block 112, which is configured to receive the frequency-domain-input-signal 130 and determine the fundamental-frequency-signal 132 by any suitable method, such as by computing a Fourier transform of the frequency-domain-input-signal 130. In other examples, the function of the pitch estimation block 112 may be provided by an external block outside of the signal processor 100.

The modelling block 102 has a modelling-output-terminal 108, configured to provide a pitch-model-signal 134 based on a periodic function, as will be discussed in more detail below.

The manipulation block 122 has a manipulation-block-input-signal-terminal 124 configured to receive a representation of the frequency-domain-input-signal 130. In this example the representation is the frequency-domain-input-signal 130, but it will be appreciated that any other signal representative of the frequency-domain-input-signal 130 could be used.

The manipulation block 122 has a model-input-terminal 126 configured to receive a representation of the pitch-model-signal 134 from the modelling block 102. In this example the representation is the pitch-model-signal 134, but it will be appreciated that any other signal representative of the pitch-model-signal 134 could be used.

The manipulation block 122 also has an output-terminal 128. The manipulation block 122 is configured to provide an output-signal 140, to the output-terminal 128, based on the frequency-domain-input-signal 130 and the pitch-model-signal 134.

The pitch-model-signal 134, determined by the modelling block 102, spans a plurality of discrete frequency bins. Each discrete frequency bin corresponds to a portion of the frequency domain. In this way, the pitch-model-signal 134 can provide a model of the frequency-domain-input-signal 130 across a continuous range within the frequency domain, between an upper frequency limit and a lower frequency limit.

Each discrete frequency bin has a respective discrete frequency bin index. For example, the lowest discrete frequency bin may have the index one, the next discrete frequency bin may have the index two, the third discrete frequency bin may have the index three, and so on.

Within each discrete frequency bin the pitch-model-signal 134 is defined by the periodic function, the fundamental frequency, the frequency-domain-input-signal 130, and the respective discrete frequency bin index. Since the pitch-model-signal 134 depends on the discrete frequency bin index, the parameters of the pitch-model-signal 134 may be different in each discrete frequency bin, thereby advantageously enabling the pitch-model-signal 134 to provide a more accurate representation of the frequency-domain-input-signal 130 than would otherwise be possible. In this way, the pitch-model-signal 134 can be manipulated differently for different frequency bins, such that, for example, the modelling of pitch jitter is possible, because the peaks of the harmonics can be shifted by differing amounts for each peak.

The pitch-model-signal 134 is based on a periodic (or, in some examples, a quasi-periodic) function of frequency. This function can be generated such that the positive peaks of the function lie around the peaks of the frequency-domain-input-signal 130, as is required for enhancement. Alternatively, if noise suppression is required, the negative peaks of the function can lie around the peaks of the frequency-domain-input-signal 130.

Figure 2:
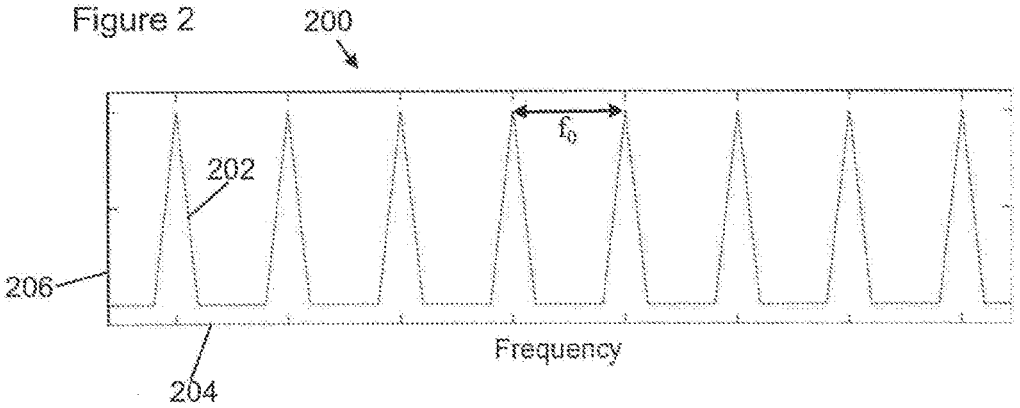
FIG. 2 shows an example embodiment of a periodic function.

FIG. 2 shows a chart 200 of an example periodic function 202. Frequency is plotted on a horizontal axis 204 and amplitude is plotted on a vertical axis 206. Peaks of the periodic function 202 are separated by integer multiples of the fundamental frequency ($f_0$) of a corresponding time domain input signal.

Figure 3:
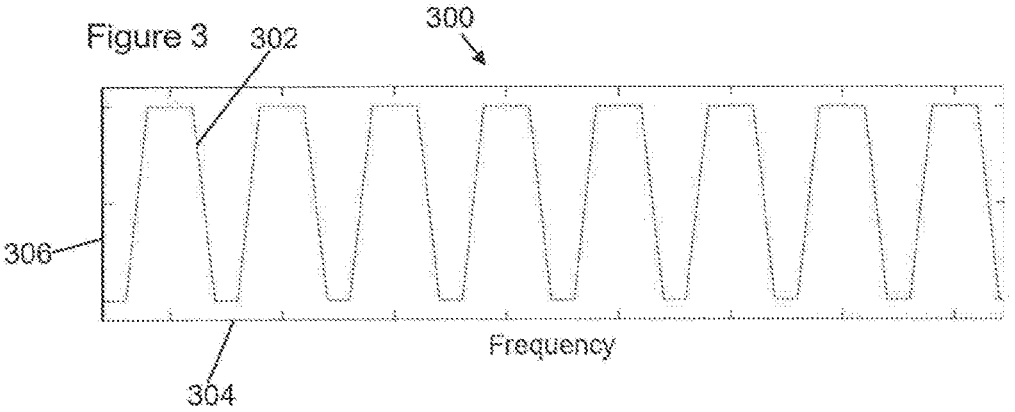
FIG. 3 shows an example embodiment of a second periodic function.

FIG. 3 shows a chart 300 of a second example of a periodic function 302. Frequency is plotted on a horizontal axis 304 and amplitude is plotted on a vertical axis 306. Peaks of the periodic function 202 are separated by integer multiples of the fundamental frequency ($f_0$) of a corresponding time domain signal.

FIGS. 2 and 3 provide two different examples of periodic functions. However, it will be appreciated that other functions, such as symmetric or asymmetric pulse trains, Dirac pulse trains or any random periodic waveform may be used by a modelling block to provide a pitch-model-signal.

It is possible to define a family of functions that allow for a very flexible modelling of a frequency-domain-input-signal to provide a good representation of an underlying speech spectrum corresponding to the frequency-domain-input-signal. The pitch-model-signal provides for advantageous ease of parameterization. Therefore, the pitch-model-signal allows, among other possibilities, a frequency-dependent width and height of peaks and the valleys of the pitch-model-signal, which enables modelling of the jitter of the harmonics that can occur in rising and falling vowel sounds in speech signals. In this context, jitter refers to deviation of the peaks of the harmonics of a signal away from integer multiples of the fundamental frequency of the signal. The pitch-model-signal may also be used for modelling the excitation spectrum across an arbitrary bandwidth/frequency range, which may be useful if a frequency-domain-input-signal has a bandwidth that is less than the bandwidth of the pitch-model-signal.

Figure 4:
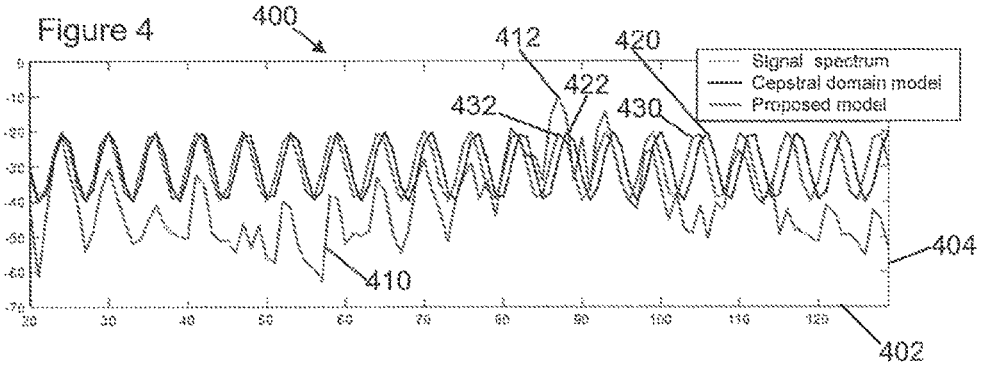
FIG. 4 shows an example embodiment of a frequency spectrum of a signal, a frequency spectrum of a model of the signal, and a frequency spectrum of an enhanced model of the signal.

FIG. 4 shows a chart 400 with frequency plotted on a horizontal axis 402 and amplitude of spectra (in dB) plotted on a vertical axis 404. The chart 400 shows a frequency-domain-input-signal 410 together with a Cepstral domain model 420 and a pitch-model-signal 430.

In this example, only the cepstral bin corresponding to the maximum for each frequency peak is retained in the Cepstral domain model 420. The frequency-domain-input-signal 410 is juxtaposed with the Cepstral domain model 420 and the pitch-model-signal 430 in order to show the relative positions of the signal peaks (corresponding to the pitch frequencies). A particular frequency peak 412 of the frequency-domain-input-signal 410 coincides in position with the corresponding particular frequency peak 432 of the pitch-model-signal 430. However, the corresponding particular frequency peak 422 of the Cepstral domain model 420 is located at a significantly higher frequency. The superior alignment of the peaks of the pitch-model-signal 430 with the peaks of the frequency-domain-input-signal 410 (compared to the peaks of the Cepstral domain model 420) shows that the pitch-model-signal 430 provides a better representation of the excitation (or the pitch harmonics) in the frequency-domain-input-signal 410.

Figure 5:
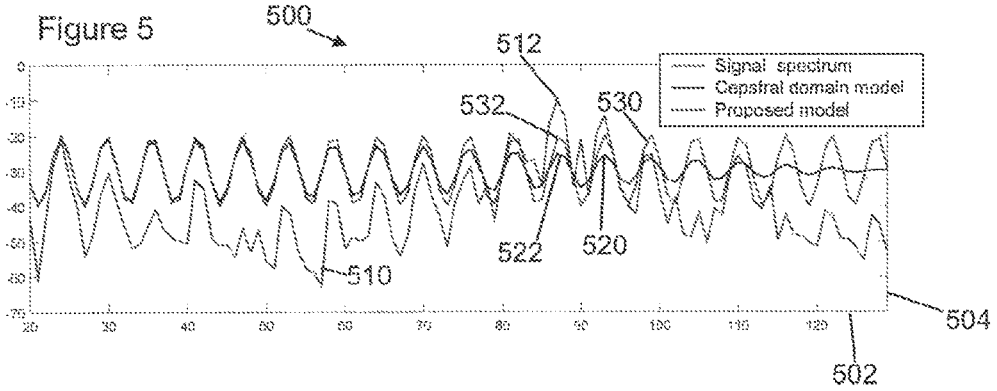
FIG. 5 shows an example embodiment of a frequency spectrum of a second signal, a frequency spectrum of a model of the second signal, and a frequency spectrum of an enhanced model of the second signal.

FIG. 5 shows a chart 500 that is similar to the chart of FIG. 4; similar features have been given similar reference numerals and may not necessarily be discussed further here. The chart 500 shows a second Cepstral domain model 520 in which one cepstral bin on either side of the maximum for each frequency peak together with the cepstral bin corresponding to the maximum are used to provide the second Cepstral domain model 520. The chart 500 also shows a frequency-domain-input-signal 510, which is the same as that shown on FIG. 4, and a pitch-model-signal 530, which is also the same as that shown in FIG. 4. It can be seen that the pitch-model-signal 510 can provide a good match with the peaks and valleys of the frequency-domain-input-signal 510 across the entire signal spectrum.

Methods according to the present disclosure can be applied to sampled signals in the time-domain that are segmented into overlapping segments and then transformed into the frequency domain by, for example, a discrete Fourier transform (DFT). To facilitate further exposition, some conventions are presented in the table below.

| | |
|---|---|
| x(n) | Time sampled signal (containing speech and noise) |
| s(n) | The underlying clean speech signal in x(n) |
| $x_l(n')$ | The l-th signal segment ($x_l(n') = x(lL + n')$), where L is the shift (in samples) between two overlapping segments. |
| X(k, l) | (Complex) representation of the signal $x_l(n')$, after segmenting and computing the DFT. Usually, the segmentation of the signal implies the use of a window function. Here k is the index of the discrete frequency bin and/represents the time-frame (or segment) under consideration. |
| $\hat{S}(k, l)$ | The clean speech signal estimated from the noisy mixture in the frequency domain. |
| $f_0$ | Fundamental frequency (pitch) of the signal (in Hz). |
| $f_s$ | Sampling frequency of the signal (in Hz). |
| N | The size of the Fourier transform |

The following description relates to the l-th signal segment, under the assumption that this segment is voiced and that there is an available $f_0$ estimate for this segment. The $f_0$ or pitch estimate may be provided by a module in the signal processing chain in accordance with techniques familiar to persons skilled in the art.

The pitch spectrum (consisting of P harmonics) can be modelled according to the following equation:

$$Y(k) = f(k) * \sum_{p=1}^{P} D(k - pf_0)$$

In this equation, D is a pulse train separated by the fundamental frequency as shown in FIGS. 2 and 3, and f(k) is any function with limited support. The operator '*' represents the convolution operation. To clarify this equation with respect to FIGS. 2 and 3, in the case of FIG. 2, f(k) would be a single triangular pulse and in the case of FIG. 3, f(k) would be a single rectangular pulse.

The periodic function used to provide the pitch-model-signal allows for the possibility of adjusting the height and width of the peaks, to be more tolerant of slight changes in periodicity and pitch frequency of an underlying frequency-domain-input-signal. Advantageously, the periodic functions can be mathematically tractable and allow for easy parameterization. An example of such a periodic function is the cosine function, because it has the desirable properties of mathematical tractability and easy parameterization while exhibiting periodic behaviour.

Figure 6:
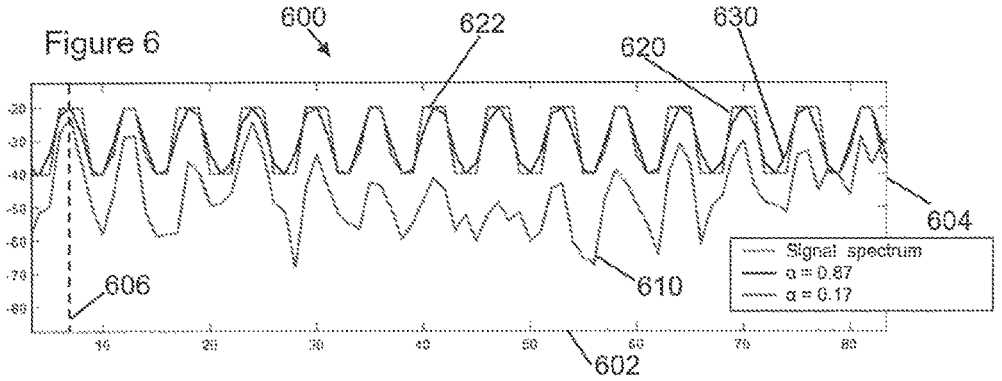
FIG. 6 shows an example embodiment of a frequency spectrum of a third signal, and two different representations of the pitch harmonics of this third signal obtained by two different parameterizations of the model.

FIG. 6 shows a chart 600 that displays a frequency-domain-input-signal 610 a first pitch-model-signal 620 and a second pitch-model-signal 630. Frequency is plotted on a horizontal axis 602 of the chart 600, while amplitude (in dB) is plotted on a vertical axis 604 of the chart 600. The pitch-model-signals 620, 630 are based on equation 1, which is shown below.

$$Y(k) = \frac{A}{\rho_k}\left(\cos(\omega_0 k)\Big]_{-\beta_k}^{\alpha_k} + \delta_k\right) \tag{1}$$

In equation 1, Y is the pitch-model-signal while the quantity $k \in \{0, 1, \ldots, N-1\}$ is the discrete frequency bin index, which in this example takes the value 0 for the first discrete frequency bin, at the lowest end of the frequency spectrum, and the value N−1 for the Nth discrete frequency bin at the highest end of the frequency spectrum.

In equation 1, A is an amplitude multiplier and $\rho_k$ is an amplitude divider. The combination of the constant amplitude multiplier (A) and the amplitude divider $\rho_k$ defines the amplitude of the periodic function. Since the amplitude divider $\rho_k$ may take different values for each discrete frequency bin, the pitch-model-signal may accurately represent differences in amplitude of different parts of the frequency-domain-input-signal 610. To achieve this accurate representation of the frequency-domain-input-signal 610 in each discrete frequency bin, each respective amplitude for each frequency bin can be determined in accordance with the frequency-domain-input-signal 610. It will be appreciated that many different techniques can be used to determine the respective amplitudes, such as techniques based on least-squares fitting, or other techniques known in the field of regression analysis.

In equation 1, the right square bracket (]) is a limiting operator in which the sub- and superscripts indicate limits on the operand. Consequently, the cosine function is truncated to an upper maximum value equal to $\alpha_k$ and a lower minimum value of $\beta_k$. The upper ($\alpha_k$) and lower ($\beta_k$) limits can be different or the same as each other. Both the upper maximum value and the lower minimum value can be determined in accordance with the frequency-domain-input-signal 610, in a way similar to the determination of different amplitudes. In some examples, either one or both of the upper maximum value and the lower minimum value may be set at levels such that the cosine function is not truncated. For example, the cosine function may be truncated at only its peaks or only its valleys or at both its peaks and valleys. The truncation is clearly visible in the first pitch-model-signal 620 at a truncated peak 622, because a relatively small value of $\alpha_k$ (equal to 0.17) has been used. Conversely, the truncation is less visible in the second pitch-model-signal 630 because a larger value of $\alpha_k$ (equal to 0.87) has been used. In these examples, the upper maximum value is equal to the lower minimum value.

In equation 1, the quantity $\delta_k$ is an offset that can be added to the periodic function. The offset can be determined for each discrete frequency bin, in accordance with the frequency-domain-input-signal 610, in a way similar to the determination of different amplitudes. In this example, the offset has been set zero, although any other value may be used.

The frequency $\omega_0$ in equation 1 is defined by the following equation 2.

$$\omega_0 = 2\pi\frac{f_s}{Nf_0} \tag{2}$$

In equation 2, $f_s$ is a sampling frequency of the original time sampled signal, while $f_0$ is the fundamental frequency and N is the size of the Fourier transform (such as a DFT)

used to convert the original time sampled signal into the frequency-domain-input-signal 610.

The pitch-model-signals 620, 630 have peaks at the fundamental frequency 606 and its harmonics, and valleys in between, which provides an idealised spectrum for the original time sampled signal. The parameters $\alpha_k$, $\rho_k$, $\delta_k$ and $\beta_k$ can be varied to control the width and depth of the cosine curve, and any of the parameters can either be fixed parameters or dependent on the frequency bin index k. Similar to models dependent on Cepstral analysis this approach to providing the pitch-model-signal can also yield a peak at zero frequency. However this zero frequency peak can easily be removed by known techniques.

The dependency of the parameters $\alpha_k$, $\rho_k$, $\delta_k$ and $\beta_k$ on k can be used to selectively control the width and depth (or equivalently the height) of a pitch-model-signal especially at its peaks and valleys. A pitch-model-signal can have narrower (more selective) peaks for the lower frequency bins, where the harmonic frequencies are usually well defined. Conversely, a pitch-model-signal can have broader peaks for the higher frequency bins, where the pitch harmonics may be increasingly smeared. In such situations a pitch-model-signal can still accurately capture the harmonics of the original time sampled signal for subsequent processing and/or enhancement.

Both the first pitch-model-signal 620 and the second pitch-model-signal 630 have peaks at the corresponding peaks in the frequency-domain-input-signal 610, indicating accurate modelling of the pitch and its harmonics. Changing the parameter a makes the cosine broader or narrower as demonstrated by the first pitch-model-signal 620 and the second pitch-model-signal 630 respectively. In FIG. 6 and succeeding figures, unless otherwise specified, the amplitude of the cosine has not been chosen based on the frequency-domain-input-signal 610, so that the correspondence between the peak positions of the respective signals can be more clearly seen. In practical applications of the present disclosure the amplitude of pitch-model-signals is computed based on the frequency-domain-input-signal 610 and optionally on the context that any such pitch-model-signal will be used in.

The present disclosure lends itself easily to further adaptation. For example, to make the pitch-model-signal of equation 1 narrower or broader, it is possible to modify equation 1 as shown below in equation 3.

$$Y(k) = \frac{A}{\rho_k}\left(\mathrm{sgn}(\cos(\omega_0 k))(|\cos(\omega_0 k)|)^{\gamma}]_{-\beta_k}^{\alpha_k} + \delta_k\right) \tag{3}$$

In equation 3, the modulus of the periodic function is exponentiated to a power $\gamma$ for each discrete frequency bin. The power $\gamma$ may be the same for each discrete frequency bin or may have a different value for different frequency bins. In either case, the power $\gamma$ is determined in accordance with the frequency-domain-input-signal 610 in a way similar to the determination of different amplitudes.

According to equation 3, $\gamma$ controls the amount of sharpening (for $\gamma>1$) or broadening (for $\gamma<1$) of the peaks and valleys in the pitch-model-signal. The "sgn( )" represents the signum function, that returns the sign of the operand.

The pitch-model-signal depends on the fundamental frequency $f_0$ which may be provided by an estimation algorithm executed by a pitch estimation block such as that shown in FIG. 1. The estimation algorithm may run at its own bandwidth, frequency resolution and frame-shift. Consequently, the fundamental frequency estimate yielded by the algorithm may be slightly different to the fundamental frequency of a particular signal frame represented by the X(k,l), for all k=0, 1, . . . N. Such deviations could have repercussions for the accuracy of the modelling of the frequency-domain-input-signal, especially at higher frequencies. Therefore, the fundamental frequency estimate may advantageously be adjusted to fit the signal frame under consideration, otherwise a modelling error will increase with frequency. Such an adjustment may be termed pitch refinement and may correct for possible deviations of the fundamental-frequency estimation from the true fundamental frequency of the considered signal frame.

Figure 7:
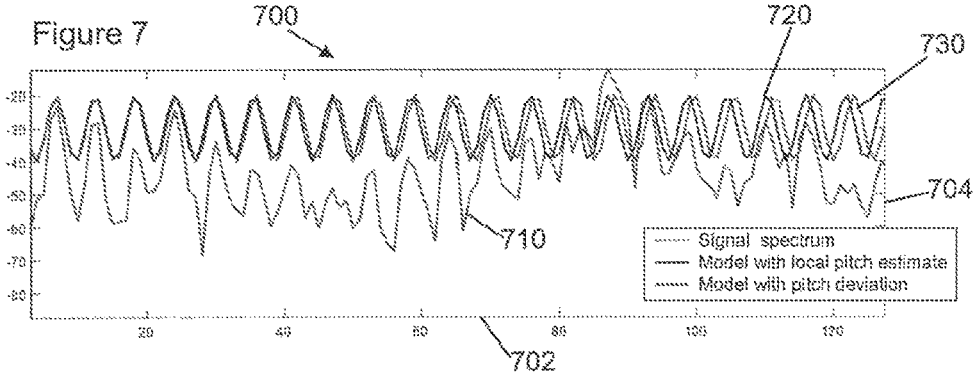
FIG. 7 shows an example embodiment of a frequency spectrum of a fourth signal, a frequency spectrum of a model of the fourth signal, and a frequency spectrum of an enhanced model of the fourth signal.

FIG. 7 shows a chart 700 that is similar to the chart of FIG. 6. Similar features have been given similar reference numerals and may not necessarily be discussed further here.

The chart 700 shows a frequency-domain-input-signal 710, a first pitch-model-signal 730 (without pitch refinement) and a second pitch-model-signal 720 (with pitch refinement). Determination of the second pitch-model-signal 720 may be performed in two stages. In a first stage, the extent of pitch deviation may be estimated and in a second stage that estimation may be used to provide the second pitch-model-signal, based on a frequency-offset determined in accordance with the frequency-domain-input-signal during the first stage. To demonstrate this mathematically, equation 1 has been appropriately modified to provide equation 4, shown below. However, it will be appreciated that corresponding modifications could also be made to equation 3.

$$Y(k) = \frac{A}{\rho_k}\left(\cos((\omega_0 + \Delta\omega)k)]_{-\beta_k}^{\alpha_k} + \delta_k\right) \tag{4}$$

In equation 4, $\Delta\omega$ is a pitch correction factor which can be obtained by, for example, a least-squares fit on a log-magnitude spectrum of X(k,l). The pitch correction factor is an example of a frequency-offset.

FIG. 7 shows that the effect of pitch deviation is very small at lower frequencies (where the peaks of the frequency-domain-input-signal 710, the first pitch-model-signal 730 and the second pitch-model-signal 720 are very close together), but quickly becomes more significant at higher frequencies (where the peak positions of the frequency-domain-input-signal 710 are close to the peak positions of the second pitch-model-signal 720 but further away from the peak positions of the first pitch-model-signal). Not correcting for pitch deviation may lead to inaccurate modelling. When the frequency is corrected as in equation 4 then the second pitch-model-signal can accurately capture the peaks and valleys in the underlying signal.

Figure 8:
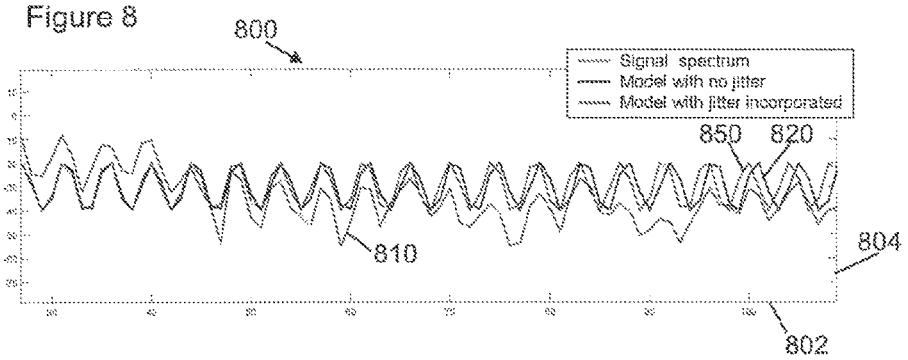
FIG. 8 shows an example embodiment of a frequency spectrum of a fifth signal, a frequency spectrum of a model of the fifth signal, and a frequency spectrum of an enhanced model of the fifth signal.

FIG. 8 shows a chart 800 that is similar to the chart of FIG. 7. Similar features have been given similar reference numerals and may not necessarily be discussed further here.

Another problem that is frequently observed when modelling the spectrum of a voiced signal is frequency jitter over the harmonics. This means that the harmonics are not positioned at integer multiples of the fundamental frequency, but are jittered around those positions. This phenomenon can be especially noticeable in a raising or falling vowel sound. A further modification to equation 4 makes it possible to account for this jitter, as shown in equation 5 below.

$$Y(k) = \frac{A}{\rho_k}\left(\cos((\omega_0 + \Delta\omega)k)]_{-\beta_k}^{\alpha_k} + \delta_k\right) \quad (5)$$

In equation 5, the pitch correction factor $\Delta\omega_k$ is a function of the frequency bin index k. The frequency jitter can then either be accounted for by searching for the optimal $\Delta\omega_k$ for each harmonic within each discrete frequency bin, or the pitch correction factor could be assumed to exhibit a particular function of the frequency bin index. For example, the pitch correction factor could be a linear function of the frequency bin index k. In some examples, this function can be parameterized, and the values of the parameters can be fitted for the frequency-domain-input-signal 810 using a least-squares fit approach.

The chart 800 shows evidence of harmonic jitter in the frequency-domain-input-signal 810, since there is a mismatch between the peaks of the first pitch-model-signal 810 (which is a cosine model without jitter) and the frequency-domain-input-signal 810. In this example, the jitter is modelled as a linear function over frequency and estimated by a least-squares fit on the log-magnitude signal spectrum to provide a second pitch-model-signal 820 in accordance with equation 5. It can be seen that the second pitch-model-signal 820 matches the valley and peak positions of the frequency-domain-input-signal 810 very well.

Figure 9:
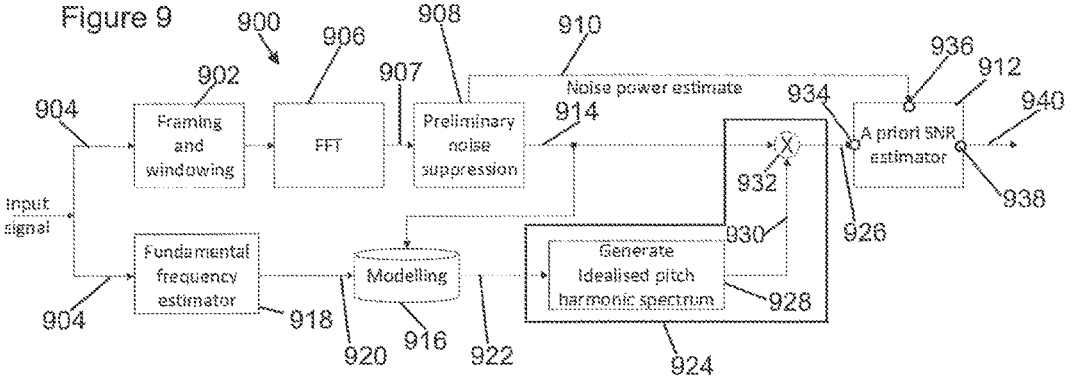
FIG. 9 shows an example embodiment of an a-priori signal to noise ratio estimator.

FIG. 9 shows a block diagram of a signal processor which is an a priori SNR estimator 900.

The a priori SNR estimator 900 has a framing and windowing block 902, configured to receive a digitized microphone signal 904 (x(n)) with a discrete-time index n. The framing and windowing block 902 processes the digitized microphone signal 904 in frames of 32 ms with a frame shift of 10 ms. Each frame with frame index I, is transformed into the frequency domain via fast Fourier transform (FFT) of size N by a Fourier transform block 906. This is an example of a processing structure and can be adjusted as needed, for example to process frames with a different duration or frame shift A common noise reduction algorithm is executed by a preliminary noise suppression block 908. The preliminary noise suppression block 908 receives each frequency domain input signal 907 and provides a noise power estimation signal 910 to an a priori SNR estimation block 912. The noise power estimation signal 910 may be denoted as: $\hat{\sigma}_n^2(k,l)$. The noise power estimation signal 910 is used for the a priori SNR estimation. Any noise power estimator known to persons skilled in the art can be used here to provide the noise power estimation signal 910.

A first estimate of the a priori SNR can be obtained by employing a decision-directed (DD) approach. For a weighting rule in the preliminary noise suppression, any spectral weighting rule known to persons skilled in the art can be employed here. In general, the parameterization and usage of different noise power estimators, a priori SNR estimators and weighting rules are free from any constraints. Thus, different methods can be used by the preliminary noise suppression block 908 to determine a preliminary de-noised signal 914. The preliminary de-noised signal 914 is an example of a frequency-domain-input-signal.

The preliminary de-noised signal 914 is provided to a modelling block 916 (which is similar to the modelling block described above in relation to FIG. 1).

The digitized microphone signal 904, or any filtered version thereof, is provided to a fundamental frequency estimation block 918 that determines an estimate of the fundamental frequency of the digitized microphone signal 904. The fundamental frequency estimation block 918 can work at a different frame rate, different bandwidth and different spectral resolution that other blocks of the a priori SNR estimator 900. All that is required from the fundamental frequency estimation block 918 is an estimate of the fundamental frequency for each frame I that is being processed. The fundamental frequency estimation block 918 provides a fundamental-frequency-signal 920 to the modelling block 916.

The modelling block 916 determines and provides a pitch-model-signal 922 to a manipulation block 924. The pitch-model-signal 922 is based on the fundamental frequency estimate and any of the equations presented above. The amplitude A is selected to appropriately emphasise the peaks and de-emphasise the valleys of the preliminary de-noised signal 914. This increases the contrast between the desired part of the spectrum (frequencies containing pitch harmonics) and the noise frequencies (that lie in between the pitch harmonics).

The manipulation block 924 receives both the pitch-model-signal 922 and the preliminary de-noised signal 914, and provides an output signal 926 to the a priori SNR estimation block 912. In this example the manipulation block 924 contains an optional idealised pitch block 928 which receives and amplifies the pitch-model-signal 922 to provide an amplified signal 930 which is combined, at a combiner 932, with the preliminary de-noised signal 914 to provide the output signal 926. The output signal 926 consists of an estimate of an underlying clean speech signal $\hat{S}(k,l)$.

The a priori noise estimation block 912 receives the output-signal 926 at a manipulation-input-terminal 934 and receives the noise power estimation signal 910 at a noise-power-estimate-terminal 936. The output-signal 926 is combined with the noise power estimation signal 910 to yield an improved a priori SNR estimation signal 940, which provides a superior estimate of the signal to noise ratio of the original digitized microphone signal 904, because the pitch-model-signal 922 provides a more accurate spectral representation of the underlying speech in the original digitized microphone signal 904. The a priori SNR estimation signal 940 is provided to an a priori SNR estimator output terminal 938 for use in further signal processing operations (not shown).

Figure 10:
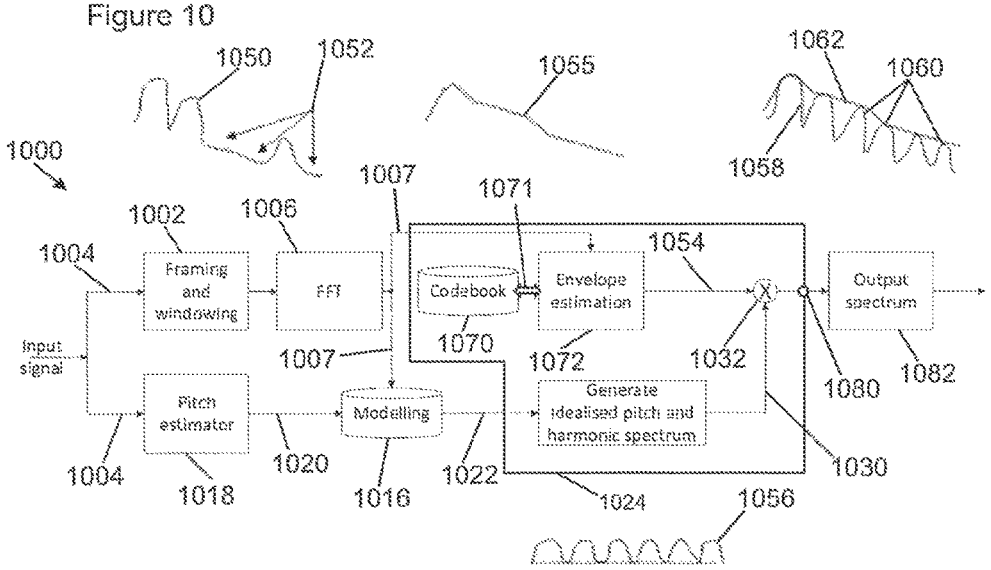
FIG. 10 shows an example embodiment of a harmonic restoration signal processor.

FIG. 10 shows a block diagram of a signal processor which is a spectral restoration processor 1000. The spectral restoration processor 1000 may also be described as a spectral extension processor, in some examples. Features of the spectral restoration processor 1000 that are similar to features shown in FIG. 9 have been given similar reference numerals in the 900 series, and may not necessarily be described further here.

In some cases a distorted input signal 1004 can be received by the spectral restoration processor 1000, which may advantageously operate to enhance the distorted input signal 1004. Some examples of distortion include the following possibilities.

- A first type of distortion may arise due to system limitations on bandwidth. In this case, only a low-bandwidth version of the input signal 1004 is available.
- A second type of distortion may arise due to prior processing in the signal chain, e.g. by noise suppression. In such cases, certain pitch harmonics may be severely attenuated in the input signal 1004.

When a distorted input signal 1004 is available, the spectral restoration processor 1000 can be used to restore distorted pitch harmonics.

In relation to the first type of distortion, spectral restoration can be referred to as bandwidth extension, and in relation to the second type of distortion, spectral restoration can be referred to as harmonic restoration.

An example of a distorted input signal 1004 is shown in a first plot 1050. The first plot 1050 shows that several harmonics 1052 appear to be missing from the distorted input signal 1004, because of distortion effects. The spectral restoration processor 1000 receives the distorted input signal 1004 and processes it to produce a frequency-domain-input-signal 1007 and a pitch-model-signal 1022 in a manner similar to that disclosed above in relation to FIG. 9.

The spectral restoration processor 1000 has a manipulation block 1024 that receives both the frequency-domain-input-signal 1007 and the pitch-model-signal 1022. The manipulation block has a codebook module 1070 and also an envelope estimation module 1072 which is configured to receive the frequency-domain-input-signal 1007. The envelope estimation module is configured to determine an envelope of the frequency-domain-input-signal 1007 and provide an envelope signal 1054 representative of the envelope. The envelope signal 1054 is illustrated in a second plot 1055. The envelope signal 1054 can be determined by any one of several methods such as by using linear prediction coefficients or cepstral coefficients. In this example, the envelope signal 1054 is also determined based on a codebook signal 1071 provided by the codebook module 1070. Determination of the envelope signal 1054 based only on the frequency-domain-input-signal 1007 may provide for a distorted envelope signal because of the distortions present in the frequency-domain-input-signal 1007. The presence of distortions may be corrected for to obtain the envelope signal 1054 that provides a good approximation to the undistorted envelope of the original signal. This can be accomplished by comparing the frequency-domain-input-signal to predetermined-envelope-data stored in the codebook module 1070, by way of a database or look-up table. In other examples, any other state-of-the-art filtering methods may be used to provide the envelope signal 1054 in a way that accurately represents the envelope of the original signal, before distortions were introduced.

The modelling block 1016 provides the pitch-model-signal 1022 in a similar way to the modelling block of FIG. 9. A third chart 1056 illustrates the pitch-model-signal 1022. As can be seen from the third chart 1056, the pitch-model-signal 1022 has re-introduced the spectral harmonics 1052 that were missing from the frequency-domain-input-signal shown in the first chart 1050, because the pitch-model-signal 1022 has six harmonic peaks whereas the frequency-domain-input-signal 1007 only contained three harmonic peaks.

For the bandwidth extension scenario, the pitch-model-signal is provided for the full-bandwidth of the original undistorted signal, thereby extending the harmonics in a natural way over the required extended bandwidth.

The envelope signal 1054 and an amplified pitch-model-signal 1030 are provided to a combiner 1032, and combined to provide an output-signal 1080. The output-signal 1080 has a spectrum 1058 (shown in a fourth chart) with the missing harmonic regions 1060 regenerated. The fourth chart also show the envelope signal 1062 overlaid on the output-signal 1058.

In some examples, combination of the envelope signal 1054 with the amplified pitch-model-signal 1030 can be performed by multiplying the signals together over all the discrete frequency bins or only over a selected subset of the discrete frequency bins where spectral harmonics have been attenuated in the distorted frequency-domain-input-signal. In bandwidth extension examples, the selected subset of discrete frequency bins may relate to frequencies that exceed a bandwidth of the frequency-domain-input-signal 1007.

The output-signal 1080 is a synthesized spectrum which is then provided to a further processing block 1082 for further processing. In some examples the output-signal 1080 may be transformed back into the time domain as a final output signal. Note that when the signal is transformed back into the time domain with the synthesized harmonics, care should be taken to modify also the phase of the harmonics, to ensure consistent phase evolution across time. Otherwise, the lack of phase consistency can lead to audible artefacts. In other examples the output-signal 1080 may be combined in a weighted manner, by a further-enhancement-block (not shown), with the frequency-domain-input-signal 1007 to yield a further enhancement signal.

The present disclosure discloses a system that can perform an explicit modelling of the pitch in the frequency domain. This model is based on a generic cosine template, but since it can be well parameterized, it can be generalised to cover a broad range of excitation functions. This allows for a very flexible modelling of the spectrum of a voiced signal.

The present approach can account for harmonic jitter and frequency mismatch between a fundamental frequency estimation algorithm and the fundamental frequency of the current spectral frame being processed. This can lead to a more robust modelling of the pitch harmonics and completely decouples the fundamental frequency estimation stage from the modelling stage. Thus the modelling stage and the fundamental frequency estimation stages can each have independently set signal bandwidths, signal framing and spectral resolution. This independence can be more difficult or even impossible under other schemes.

Aspects of the present disclosure can be incorporated into any speech processing and/or enhancement system that requires a clean speech estimate or an a priori SNR estimate. In addition, it can also be used to reconstruct missing harmonics or to resynthesize harmonic segments in a synthetic manner, where the signal-to-noise ratio is very poor. Since it is possible to perform a refinement of the fundamental-frequency estimate it is also possible to provide an improved fundamental frequency estimate to any application that makes use of the fundamental frequency. This modelling can also be used for multi-pitch grouping and, by extension, also to source separation and/or classification applications.

Multi- or single-channel applications such as noise reduction, speech presence probability estimation, voice activity detection, intelligibility enhancement, voice conversion, speech synthesis, bandwidth extension, beamforming, means of source separation, automatic speech recognition or speaker recognition, can benefit in different ways from aspects of the present disclosure.

Aspects of the present disclosure can provide additional flexibility, which can allow its applicability with any pitch estimator and enhancement framework. Furthermore, the flexibility of the modelling also implies that the pitch estimation need not be synchronous with the signal frame being processed, since an appropriate correction factor can be explicitly included in the model and may be utilized if desired.

Aspects of the present disclosure are not constrained to fundamental frequency estimation and manipulation in the cepstral domain. This is advantageous because fundamental frequency computation and excitation spectrum generation are linked. Use of an external fundamental frequency estimator requires additional computations to translate this information to the cepstral domain. When the excitation signal spectrum is generated by manipulating the cepstral domain representation, it can be limited in its accuracy in some applications. Specifically, when only the cepstral bin with the largest amplitude (and/or its immediate neighbours) is (are) retained in the modified cepstrum, the modelling of the excitation spectrum may not match the true spectrum, particularly for higher frequencies.

Other methods may apply a non-linearity in the time-domain to help generate missing harmonics. The choice of the non-linearity plays a role here, since this will generate sub- and super-harmonics of the fundamental frequency over the whole frequency domain. This can introduce a bias in the a priori SNR estimator. One effect of this bias is the introduction of a false 'half-zeroth' harmonic prior to the fundamental frequency, and can cause the persistence of low-frequency noise when speech is present. Such problems can be overcome, reduced or avoided by using aspects of the present disclosure.

Another effect of the abovementioned bias is the limitation of the over-estimation of the pitch harmonics, which can limit the reconstruction of weak harmonics. This limitation arises because an over-estimation can also potentially lead to less noise suppression in the intra-harmonic frequencies. There can be, thus, a poorer trade-off between speech preservation (weak harmonics) and noise suppression (between harmonics). If the generation of the missing harmonics is performed in the time domain, it may not allow for frequency-dependent over- or under-estimation. The inability to perform frequency-dependent manipulation can also mean that it is not possible to model harmonic jitter, unlike aspects of the present invention which can introduce an explicit modelling of the excitation signal spectrum, and may not introduce this bias in the estimator. Aspects of the present disclosure allow for frequency-dependent over- and under-estimation of the a priori SNR. This can be used to improve the contrast between speech harmonics and the inter-harmonic noise regions in a speech enhancement stage.

It is possible to generate the excitation spectrum by using prototype pitch impulses spaced at intervals corresponding to the reciprocal of the fundamental frequency in the time domain. Such time-domain manipulations can also suffer from fundamental frequency estimation errors. Also, if the excitation signal is generated in the time domain from prototype impulses, modelling of the harmonic jitter may not be possible. Time domain manipulations work by synthesizing a speech signal. Therefore, they can require precise pitch information and phase alignment when constructing the excitation signal, as slight deviations can be audible as artefacts. Conversely, aspects of the present disclosure can be used for signal enhancement in the traditional framework as well as for speech synthesis. When modelling is in the spectral domain, frequency dependent manipulations are easily possible, allowing emphasis and/or de-emphasis of frequency regions as desired. By taking care of the phase alignment across frames when reconstructing the signal from frequency domain, speech synthesis can also be advantageously achieved.

In another time-domain approach, instead of a prototype pitch impulse stored in a codebook, a fundamental frequency dependent synthetic excitation spectrum could be used. This synthetic excitation spectrum is obtained by individually modelling each harmonic component in the time-domain. However, the harmonics are taken as integer multiples of the fundamental frequency, which can make it difficult to model harmonic jitter. Such time-domain approaches can emphasise particular harmonics (i.e. frequency dependent emphasis of the harmonics), but may not be able to de-emphasise the regions between the harmonics. Aspects of the present disclosure make it possible not only to emphasise the harmonics (the peaks in the signal spectrum) but also control the depth and width of the valleys. This helps in additionally reducing the noise between two harmonics. Also, since the harmonics are taken as integer multiples of the fundamental frequency, this should be estimated very precisely, otherwise the model may be mismatched at higher frequencies. Whereas, according to the present disclosure even if there is a mismatch between the estimated fundamental frequency from the fundamental frequency estimator and the fundamental frequency of the signal frame being analysed, this can be accounted for, as described above. Thus, the mismatch at the higher frequencies can be reduced/avoided.

Another approach models a complex gain function in a post-processing stage. Whereas, aspects of the present disclosure are used to estimate the harmonic spectrum itself. The fundamental frequency estimate in a complex gain function approach can be based on a long-term linear prediction approach. This approach, which can be dependent on the long-term evolution of the signal, can yield a fundamental frequency estimate that deviates from the fundamental frequency of the current frame. As a result, the model can suffer from model mismatch in the higher frequencies due to the deviation in the fundamental frequency. This deviation may not be corrected in a complex gain function approach and therefore the gain function can be applied in the low-frequency regions only. This can be a shortcoming of the complex gain function approach. Aspects of the present disclosure can be applied to the entire frequency spectrum and can also refine the fundamental frequency estimate so that the deviations from the fundamental frequency estimation module can be accurately compensated. Since the complex gain function approach can model a gain function, it may not be used to emphasise harmonics. Aspects of the present disclosure may not suffer from this constraint. The amplitude A, as discussed above, can be chosen to emphasise the harmonics, if required. The complex gain function approach can model a complex gain function, that is, both the phase and amplitude are modified by the gain. If this phase is not properly estimated, or if the fundamental frequency estimate is in error, this approach can introduce artefacts into the signal. Aspects of the present disclosure can model the amplitude and may not disturb the phase of the signal, and therefore do not suffer from this drawback. The complex gain function approach may not allow for easy manipulation. It may have only two (related) parameters and with the maximum gain limited to 1, it can only control the depth of the gain function. Aspects of the present disclosure provide a more easily parameterized model by means of which it can be possible to control the height and depth of the peaks and valleys as well as their width. Furthermore, it can be possible to do this in a frequency dependent manner.

Aspects of the present disclosure provide a method to model the excitation signal consisting of the pitch harmonics in the spectral domain for speech processing. It can be utilized for multi- or single-channel speech processing applications such as, for example, noise reduction, source separation, voice activity detection, bandwidth extension, echo suppression, intelligibility improvement, etc. Within such an application, this disclosure can be used in several ways. For example, in noise reduction this method can be used to improve the estimates of the relevant algorithm parameters such as the a priori SNR, which is used for the gain computation, or to directly reconstruct the enhanced speech signal. Aspects of the present disclosure can combine statistical modelling along with knowledge of the properties of the speech signal during voicing and can thereby be able to preserve (and/or reconstruct) even weak harmonic structures of the speech in a signal. A core feature is a family of functions used to model the spectrum of the pitch harmonics. With this, the model can be well parameterized and tuned as required by the application. Moreover, this model can be independent of the particular fundamental frequency estimation approach.

The instructions and/or flowchart steps in the above figures can be executed in any order, unless a specific order is explicitly stated. Also, those skilled in the art will recognize that while one example set of instructions/method has been discussed, the material in this specification can be combined in a variety of ways to yield other examples as well, and are to be understood within a context provided by this detailed description.

In some example embodiments the set of instructions/method steps described above are implemented as functional and software instructions embodied as a set of executable instructions which are effected on a computer or machine which is programmed with and controlled by said executable instructions. Such instructions are loaded for execution on a processor (such as one or more CPUs). The term processor includes microprocessors, microcontrollers, processor modules or subsystems (including one or more microprocessors or microcontrollers), or other control or computing devices. A processor can refer to a single component or to plural components.

In other examples, the set of instructions/methods illustrated herein and data and instructions associated therewith are stored in respective storage devices, which are implemented as one or more non-transient machine or computer-readable or computer-usable storage media or mediums. Such computer-readable or computer usable storage medium or media is (are) considered to be part of an article (or article of manufacture). An article or article of manufacture can refer to any manufactured single component or multiple components. The non-transient machine or computer usable media or mediums as defined herein excludes signals, but such media or mediums may be capable of receiving and processing information from signals and/or other transient mediums.

Example embodiments of the material discussed in this specification can be implemented in whole or in part through network, computer, or data based devices and/or services. These may include cloud, internet, intranet, mobile, desktop, processor, look-up table, microcontroller, consumer equipment, infrastructure, or other enabling devices and services. As may be used herein and in the claims, the following non-exclusive definitions are provided.

In one example, one or more instructions or steps discussed herein are automated. The terms automated or automatically (and like variations thereof) mean controlled operation of an apparatus, system, and/or process using computers and/or mechanical/electrical devices without the necessity of human intervention, observation, effort and/or decision.

It will be appreciated that any components said to be coupled may be coupled or connected either directly or indirectly. In the case of indirect coupling, additional components may be located between the two components that are said to be coupled.

In this specification, example embodiments have been presented in terms of a selected set of details. However, a person of ordinary skill in the art would understand that many other example embodiments may be practiced which include a different selected set of these details. It is intended that the following claims cover all possible example embodiments.

The invention claimed is:

1. A signal processor comprising:

a modelling block, comprising a modelling-block-input-signal-terminal configured to receive a frequency-domain-input-signal;

a fundamental-frequency-input-terminal configured to receive a fundamental-frequency-signal representative of a fundamental frequency of the frequency-domain-input-signal; and a modelling-output-terminal, configured to provide a pitch-model-signal based on a periodic function, the pitch-model-signal spanning a plurality of discrete frequency bins, each discrete frequency bin having a respective discrete frequency bin index, wherein within each discrete frequency bin the pitch-model-signal is defined by:

the periodic function;

the fundamental frequency;

the frequency-domain-input-signal; and the respective discrete frequency bin index, a manipulation block, comprising:

a manipulation-block-input-signal-terminal configured to receive the frequency-domain-input-signal;

a model-input-terminal configured to receive the pitch-model-signal from the modelling block; and an output-terminal, wherein the manipulation block is configured to provide an output-signal, to the output-terminal, based on the frequency-domain-input-signal and the pitch-model-signal; and wherein the pitch-model-signal comprises an offset, added to the periodic function, for each discrete frequency bin, each respective offset determined in accordance with the frequency-domain-input-signal.

2. The signal processor of claim 1, wherein the pitch-model-signal comprises an amplitude for each discrete frequency bin, each respective amplitude determined in accordance with the frequency-domain-input-signal.

3. The signal processor of claim 1, wherein the pitch-model-signal is limited to an upper maximum value for each discrete frequency bin, each respective upper maximum value determined in accordance with the frequency-domain-input-signal.

4. The signal processor of claim 1, wherein the pitch-model-signal is limited to a lower minimum value for each discrete frequency bin, each respective lower minimum value determined in accordance with the frequency-domain-input-signal.

5. The signal processor of claim 1, wherein the pitch-model-signal is based on a modulus of the periodic function exponentiated to a power for each discrete frequency bin, each respective power determined in accordance with the frequency-domain-input-signal.

6. The signal processor of claim 1, wherein the pitch-model-signal comprises a frequency-offset determined in accordance with the frequency-domain-input-signal.

7. The signal processor of claim 1, wherein the pitch-model-signal comprises a frequency-offset for each discrete frequency bin, each respective frequency-offset determined in accordance with the frequency-domain-input-signal.

8. The signal processor of claim 1, wherein the periodic function is a cosine function.

9. The signal processor of claim 1, further comprising an a-priori-signal-to-noise-ratio-estimation block, comprising:

a noise-power-estimate-terminal, configured to receive a noise-power-estimate-signal based on the frequency-domain-input-signal;

a manipulation-input-terminal coupled to the output-terminal of the manipulation block and configured to receive the output-signal; and an a-priori-signal-to-noise-ratio-estimation-output terminal, configured to provide an a-priori-signal-to-noise-ratio-estimation-signal based on the noise-power-estimate-signal and the output-signal.

10. The signal processor of claim 1, wherein the manipulation block further comprises an envelope-estimation-block configured to receive the frequency-domain-input-signal and determine an envelope-signal based on the frequency-domain-input-signal and predetermined-envelope-data, and wherein the manipulation block is configured to provide the output-signal based on a combination of the pitch-model-signal and the envelope-signal.

11. The signal processor of claim 10, wherein the manipulation block is configured to provide the output-signal based on a product of the envelope-signal with the pitch-model-signal for a selected subset of the plurality of discrete frequency bins.

12. The signal processor of claim 11, wherein the selected subset of the plurality of discrete frequency bins relate to frequencies that exceed a bandwidth of the frequency-domain-input-signal.

13. A computer program, including a non-transitory, tangible machine readable storage medium containing executable machine instructions which when run on a computer, causes the computer to configure a signal processor of claim 1.

14. A method of signal processing comprising:

receiving a frequency-domain-input-signal;

receiving a fundamental-frequency-signal representative of a fundamental frequency of the frequency-domain-input-signal; and providing a pitch-model-signal based on a periodic function, the pitch-model-signal spanning a plurality of discrete frequency bins, each discrete frequency bin having a respective discrete frequency bin index, wherein within each discrete frequency bin the pitch-model-signal is defined by:

the periodic function;

the fundamental frequency;

the frequency-domain-input-signal; and the respective discrete frequency bin index, receiving the frequency-domain-input-signal;

receiving the pitch-model-signal; and providing an output-signal based on the frequency-domain-input-signal and the pitch-model-signal wherein the pitch-model-signal includes an offset, added to the periodic function, for each discrete frequency bin, each respective offset determined in accordance with the frequency-domain-input-signal.

15. A signal processor comprising:

a modelling block, comprising a modelling-block-input-signal-terminal configured to receive a frequency-domain-input-signal;

a fundamental-frequency-input-terminal configured to receive a fundamental-frequency-signal representative of a fundamental frequency of the frequency-domain-input-signal; and a modelling-output-terminal, configured to provide a pitch-model-signal based on a periodic function, the pitch-model-signal spanning a plurality of discrete frequency bins, each discrete frequency bin having a respective discrete frequency bin index, wherein within each discrete frequency bin the pitch-model-signal is defined by:

the periodic function;

the fundamental frequency;

the frequency-domain-input-signal; and the respective discrete frequency bin index, a manipulation block, comprising:

a manipulation-block-input-signal-terminal configured to receive the frequency-domain-input-signal;

a model-input-terminal configured to receive the pitch-model-signal from the modelling block; and an output-terminal, wherein the manipulation block is configured to provide an output-signal, to the output-terminal, based on the frequency-domain-input-signal and the pitch-model-signal; and wherein the pitch-model-signal is limited to either, an upper maximum value for each discrete frequency bin, each respective upper maximum value determined in accordance with the frequency-domain-input-signal, or a lower minimum value for each discrete frequency bin, each respective lower minimum value determined in accordance with the frequency-domain-input-signal.

* * * * *